US012031322B2

(12) United States Patent
Krick et al.

(10) Patent No.: US 12,031,322 B2
(45) Date of Patent: Jul. 9, 2024

(54) SAG-RESISTANT ACOUSTIC BOARD

(71) Applicant: ARMSTRONG WORLD INDUSTRIES, INC., Lancaster, PA (US)

(72) Inventors: Charles G Krick, Lititz, PA (US); Bruce E Adams, Lancaster, PA (US); Kimberly S Diffenbaugh, Lancaster, PA (US)

(73) Assignee: AWI Licensing LLC, Wilmington, DE (US)

( * ) Notice: Subject to any disclaimer, the term of this patent is extended or adjusted under 35 U.S.C. 154(b) by 1002 days.

(21) Appl. No.: 16/918,125

(22) Filed: Jul. 1, 2020

(65) Prior Publication Data

US 2021/0002890 A1 Jan. 7, 2021

Related U.S. Application Data

(60) Provisional application No. 62/869,310, filed on Jul. 1, 2019.

(51) Int. Cl.

| | |
|---|---|
| ***E04B 1/86*** | (2006.01) |
| ***D21H 11/18*** | (2006.01) |
| ***D21H 13/40*** | (2006.01) |
| ***D21H 17/28*** | (2006.01) |
| ***D21H 17/68*** | (2006.01) |
| ***D21J 1/20*** | (2006.01) |
| ***E04B 1/74*** | (2006.01) |

(52) U.S. Cl.

CPC ..... *E04B 1/86* (2013.01); *D21H 11/18* (2013.01); *D21H 13/40* (2013.01); *D21H 17/28* (2013.01); *D21H 17/68* (2013.01); *D21J 1/20* (2013.01); *E04B 2001/745* (2013.01); *E04B 2103/04* (2013.01)

(58) Field of Classification Search

CPC .. E04B 1/86; E04B 2001/745; E04B 2103/04; D21H 11/18; D21H 13/40; D21H 17/28; D21H 17/68; D21J 1/20

See application file for complete search history.

(56) References Cited

U.S. PATENT DOCUMENTS 11,668,091 B2 * 6/2023 Kragness ..... E04B 1/86 181/175
2002/0187329 A1 * 12/2002 Ista ..... D04H 1/492 428/292.1

(Continued)

FOREIGN PATENT DOCUMENTS

JP 2002-038623 2/2002
WO WO 2005-100708 10/2005

(Continued)

OTHER PUBLICATIONS

PCT Search Report for Related Application No. PCT/2020/040425 mailed Oct. 27, 2020.

*Primary Examiner* — Forrest M Phillips
(74) *Attorney, Agent, or Firm* — Patrick Sheldrake

(57) ABSTRACT

Described herein is an acoustic building panel comprising a body comprising inorganic fiber in an amount ranging from about 60.0 wt. % to about 90.0 wt. % based on the total weight of the body; and microfibrillated fiber in an amount ranging from about 0.5 wt. % to about 10 wt. % based on the total weight of the body.

19 Claims, 3 Drawing Sheets

(56) References Cited

U.S. PATENT DOCUMENTS

| | | | | |
|---|---|---|---|---|
| 2003/0060113 | A1* | 3/2003 | Christie | D04H 1/52 442/364 |
| 2010/0272980 | A1* | 10/2010 | Kowata | C08B 11/02 428/220 |
| 2015/0033983 | A1 | 2/2015 | Bilodeau et al. | |
| 2015/0184374 | A1 | 7/2015 | Kang et al. | |
| 2016/0102018 | A1 | 4/2016 | Dorris et al. | |
| 2017/0334163 | A1* | 11/2017 | Pape | B32B 5/028 |
| 2018/0324526 | A1* | 11/2018 | Itano | H04R 31/003 |
| 2019/0232522 | A1* | 8/2019 | Page | D21J 1/04 |

FOREIGN PATENT DOCUMENTS

| | | | | |
|---|---|---|---|---|
| WO | WO 2015-175733 | | 11/2015 | |
| WO | WO-2019231994 | A1 * | 12/2019 | B32B 13/14 |

* cited by examiner

SAG-RESISTANT ACOUSTIC BOARD

CROSS-REFERENCE TO RELATED APPLICATIONS

This application claims the benefit of U.S. Provisional Application No. 62/869,310, filed on Jul. 1, 2019. The disclosure of the above application is incorporated herein by reference.

BACKGROUND

Building panels—specifically acoustically pervious ceiling panels—have a tendency to sag when exposed to high-humidity environments. These building panels, which are formed from fibrous material, are put under added stress in high-humidity environments because the amount of water absorbed by the building panel increases. Previous attempts at preventing such sagging and included adding other non-fibrous components as a way to impart additional strength to the panel. However, such components have a detrimental effect on the acoustic properties of the resulting building panel. Thus, there exists a need for a building panel having greater resistance to sagging without sacrificing the acoustical properties of such panel.

BRIEF SUMMARY

According to some embodiments, the present invention is directed to an acoustic building panel comprising: a body comprising: inorganic fiber in an amount ranging from about 60.0 wt. % to about 90.0 wt. % based on the total weight of the body; and microfibrillated fiber in an amount ranging from about 0.25 wt. % to about 12.5 wt. % based on the total weight of the body.

Other embodiments of the present invention include an acoustic building panel comprising: a body comprising: inorganic fiber; microfibrillated fiber; wherein the body has a bulk density ranging from about 96 $kg/m^3$ to about 480 $kg/m^3$.

Other embodiments of the present invention include an acoustic building panel comprising: a body comprising: inorganic fiber; microfibrillated fiber; wherein the body has a porosity ranging from about 80.0% to about 95.0%.

Other embodiments of the present invention include a ceiling system comprising: a support structure; and at least one of the previously discussed acoustic building panels.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
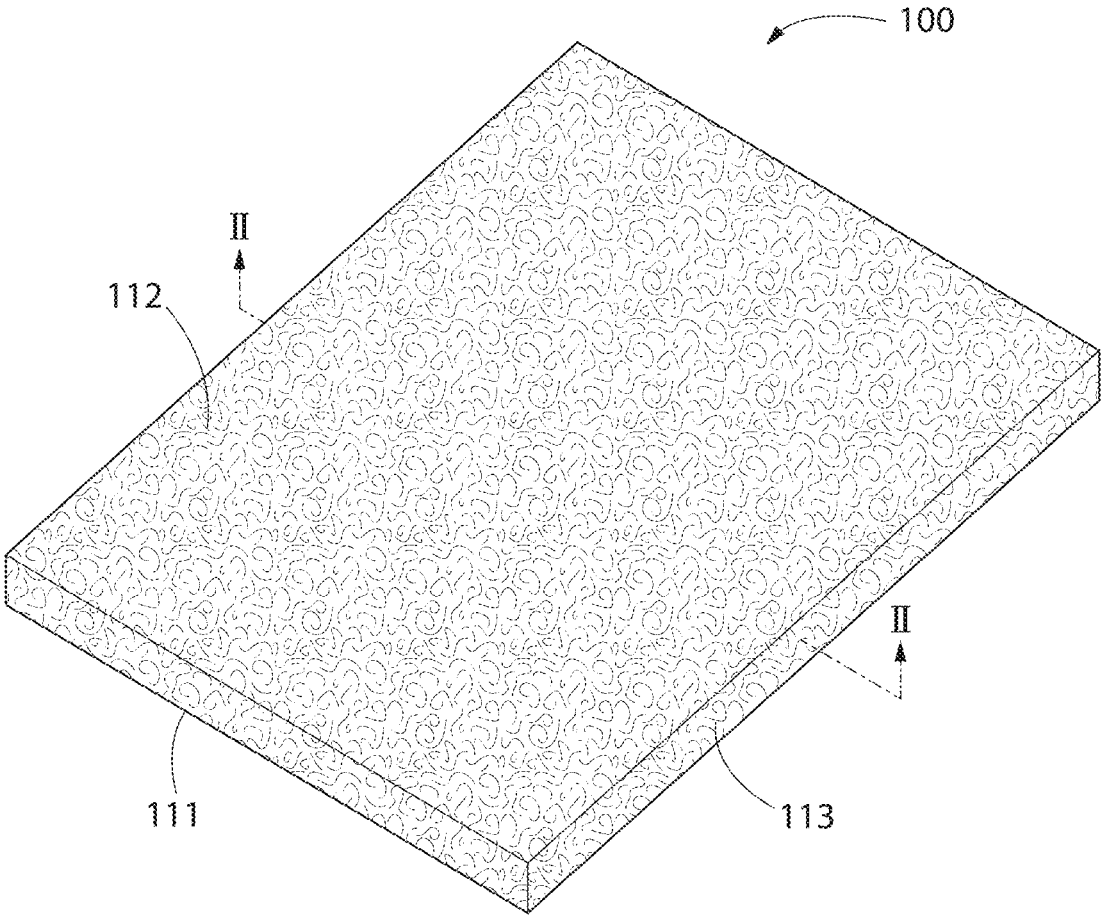
FIG. 1 is top perspective view of a building panel according to the present invention.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such.

Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Unless otherwise specified, all percentages and amounts expressed herein and elsewhere in the specification should be understood to refer to percentages by weight. The amounts given are based on the active weight of the material. According to the present application, the term "about" means+/−5% of the reference value. According to the present application, the term "substantially free" less than about 0.1 wt. % based on the total of the referenced value.

Referring to FIG. 1, the building panel 100 of the present invention may comprise a first major surface 111 opposite a second major surface 112. The ceiling panel 100 may further comprise a side surface 113 that extends between the first major surface 111 and the second major surface 112, thereby defining a perimeter of the ceiling panel 100.

Figure 3:
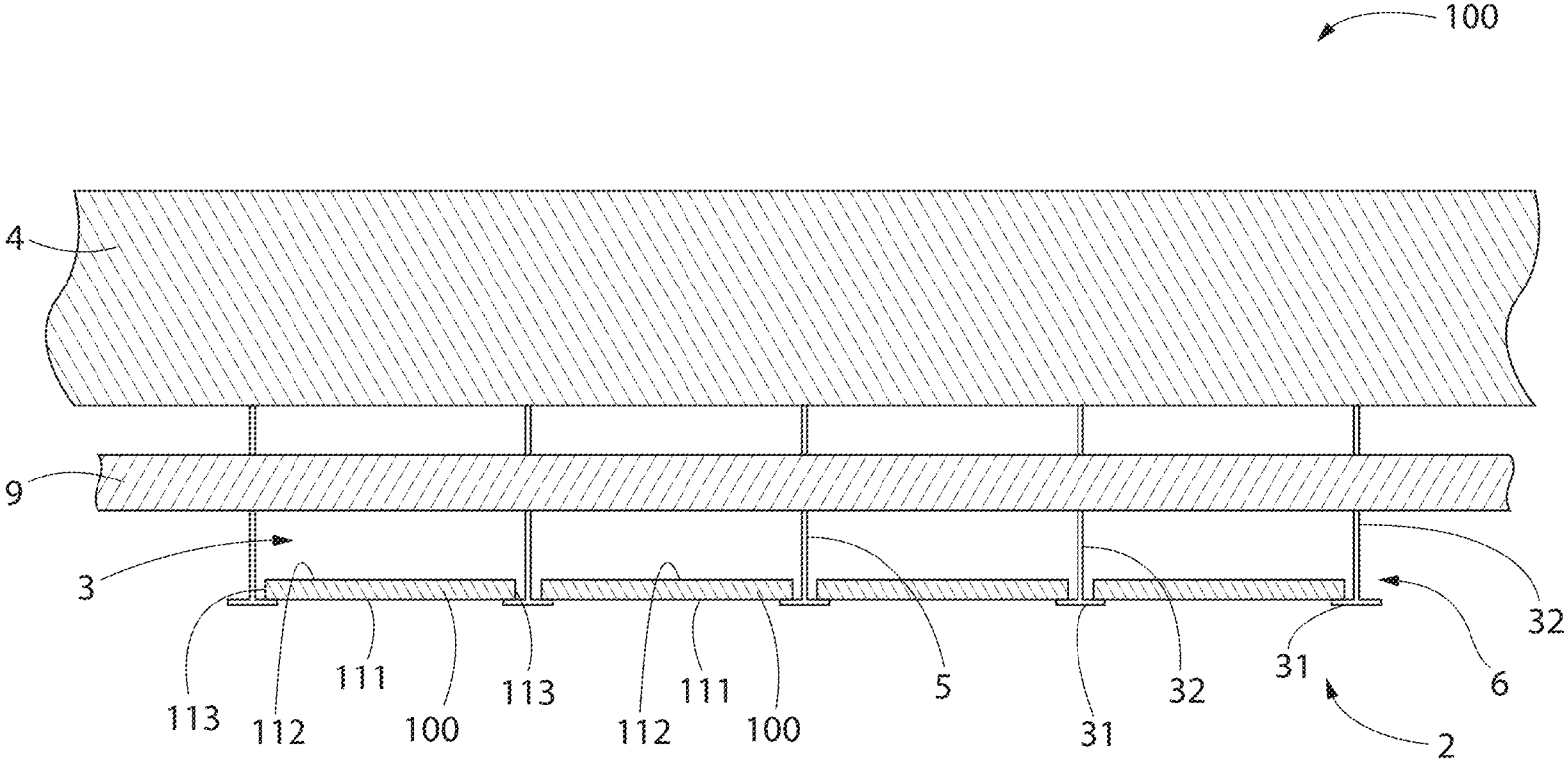
FIG. 3 is a ceiling system comprising the building panel of the present invention.

Referring to FIG. 3, the present invention may further include a ceiling system 1 comprising one or more of the building panels 100 installed in an interior space, whereby the interior space comprises a plenary space 3 and an active room environment 2. The plenary space 3 provides space for mechanical lines 9 within a building (e.g., HVAC, plumbing, etc.). The active space 2 provides room for the building occupants during normal intended use of the building (e.g., in an office building, the active space would be occupied by offices containing computers, lamps, etc.).

In the installed state, the building panels 100 may be supported in the interior space by one or more parallel support struts 5. Each of the support struts 5 may comprise an inverted T-bar having a horizontal flange 31 and a vertical web 32. The ceiling system 1 may further comprise a plurality of first struts that are substantially parallel to each other and a plurality of second struts that are substantially perpendicular to the first struts (not pictured). In some embodiments, the plurality of second struts intersects the plurality of first struts to create an intersecting ceiling support grid 6. The plenary space 3 exists above the ceiling support grid and the active room environment 2 exists below the ceiling support grid 6.

In the installed state, the first major surface 111 of the building panel 100 faces the active room environment 2 and the second major surface 112 of the building panel 100 faces the plenary space 3. The building panels 100 of the present invention have superior stain and sag resistance without sacrificing the desired airflow properties required for the building panels 100 to functional as acoustical ceiling tiles—as discussed further herein.

The ceiling system 1 of the present invention may include the ceiling support grid 6 and at least one building panel 100 supported by the ceiling support grid, the building panel 100 having the first major surface 111 opposite the second major surface 112, and the second major surface 112 facing upward and the first major surface 111 facing downward.

Figure 2:
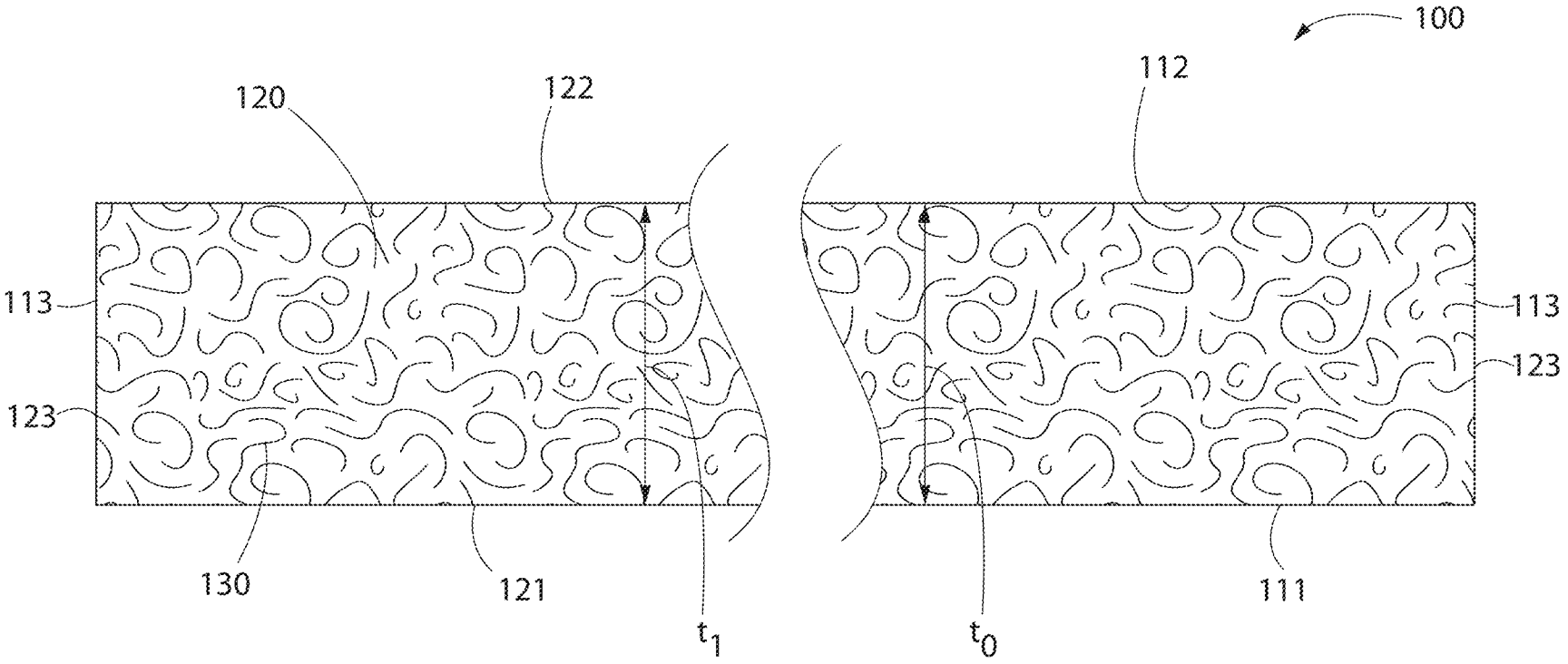
FIG. 2 is a cross-sectional view of the building panel according to the present invention, the cross-sectional view being along the II line set forth in FIG. 1.

Referring now to FIGS. 1 and 2, the building panel 100 of the present invention may have a panel thickness $t_0$ as measured from the first major surface 111 to the second major surface 112. The panel thickness $t_0$ may range from about 12 mm to about 40 mm—including all values and sub-ranges there-between. The building panel 100 may have a length ranging from about 30 cm to about 310 cm—including all values and sub-ranges there-between. The building panel 100 may have a width ranging from about 10 cm to about 125 cm—including all values and sub-ranges there-between.

The building panel 100 may comprise a body 120 having an upper surface 122 opposite a lower surface 121 and a body side surface 123 that extends between the upper surface 122 and the lower surface 121, thereby defining a perimeter of the body 120. The body 120 may have a body thickness $t_1$ that extends from the upper surface 122 to the lower surface 121. The body thickness $t_1$ may range from about 12 mm to about 40 mm—including all values and sub-ranges there-between.

The first major surface 111 of the building panel 100 may comprise the lower surface 121 of the body 120. The second major surface 112 of the building panel 100 may comprise the upper surface 122 of the body 120. When the first major surface 111 of the building panel 100 comprises the lower surface 121 of the body 120 and the second major surface 112 of the building panel 100 comprises the upper surface 122 of the body 120, the panel thickness $t_0$ is substantially equal to the body thickness $t_1$.

As discussed in greater detail herein, the body 120 may be porous, thereby allowing airflow through the body 120 between the upper surface 122 and the lower surface 121.

The body 120 may be comprised of fibers 130. The fibers 130 may comprise a first fibrous component and a second fibrous component. The first fibrous component may comprise organic fiber, inorganic fiber, and combinations thereof. The second fibrous component may comprise microfibrillated cellulose. In some embodiments, the body 120 may further comprise a filler and/or additive. The body 120 may further comprise a binder.

The first fibrous component of the fibers 130 may be organic fibers, inorganic fibers, or a blend thereof. Non-limiting examples of inorganic fibers mineral wool (also referred to as slag wool), rock wool, stone wool, and glass fibers. Non-limiting examples of organic fiber include fiberglass, macroscopic cellulosic fibers (e.g. paper fiber—such as newspaper, hemp fiber, jute fiber, flax fiber, wood fiber, or other natural fibers), polymer fibers (including polyester, polyethylene, aramid—i.e., aromatic polyamide, and/or polypropylene), protein fibers (e.g., sheep wool), and combinations thereof. Depending on the specific type of material, the first fibrous component may either be hydrophilic (e.g., macroscopic cellulosic fibers) or hydrophobic (e.g. fiberglass, mineral wool, rock wool, stone wool).

The first fibrous component may be present in an amount ranging from about 60 wt. % to about 95 wt. % based on the total dry weight of the body 120—including all values and sub-ranges there-between. In some embodiments, the first fibrous component may be present in an amount ranging from about 65 wt. % to about 90 wt. % based on the total dry weight of the body 120—including all values and sub-ranges there-between. In some embodiments, the first fibrous component may be present in an amount ranging from about 70 wt. % to about 85 wt. % based on the total dry weight of the body 120—including all values and sub-ranges there-between.

The phrase "dry-weight" refers to the weight of a referenced component without the weight of any carrier. Thus, when calculating the weight percentages of components in the dry-state, the calculation should be based solely on the solid components (e.g., binder, filler, hydrophobic component, fibers, etc.) and should exclude any amount of residual carrier (e.g., water, VOC solvent) that may still be present from a wet-state, which will be discussed further herein. According to the present invention, the phrase "dry-state" may also be used to indicate a component that is substantially free of a carrier, as compared to the term "wet-state," which refers to that component still containing various amounts of carrier—as discussed further herein.

In a non-limiting example, the first fibrous component may be inorganic fiber, such as mineral wool, whereby the inorganic fiber is present in an amount ranging from about 65 wt. % to about 85 wt. %—including all weight percentages and sub-ranges there-between—based on the total weight of the body 120. In a non-limiting example, the first fibrous component may be inorganic fiber, such as mineral wool, whereby the inorganic fiber is present in an amount ranging from about 70 wt. % to about 80 wt. %—including all weight percentages and sub-ranges there-between—based on the total weight of the body 120.

In a non-limiting embodiment, the first fibrous component may further comprise macroscopic cellulosic fiber, such as recycled newspaper. In a non-limiting example, the macroscopic cellulosic fiber may be present in an amount ranging from about 0.1 wt. % to about 3.0 wt. %—including all weight percentages and sub-ranges there-between—based on the total weight of the body 120. In a non-limiting example, the first fibrous component may further comprise macroscopic cellulosic fiber in an amount ranging from about 0.5 wt. % to about 2.0 wt. %—based on the total weight of the body 120.

The diameter of the first fibrous component may range from about 4 μm to about 10 μm—including all diameters and sub-ranges there-between. In some embodiments, the diameter of the first fibrous component may range from about 4 μm to about 8 μm—including all diameters and sub-ranges there-between. The length of the first fibrous component may range from about 1 mm to about 5 mm—including all lengths and sub-ranges there-between.

The second fibrous component of the fibers 130 may be microfibrillated cellulose. The microfibrillated cellulose may be an organic material, but for the purposes of the present invention, the microfibrillated cellulose is different from the organic fiber of the first fibrous component.

The microfibrillated cellulose may be formed from macroscopic cellulosic fibers (e.g. paper fiber—such as newspaper, hemp fiber, jute fiber, flax fiber, wood fiber, or other natural fibers), whereby the macroscopic cellulosic fiber is processed such that the outer layer of the macroscopic cellulosic fibers are stripped away to expose the underlying fibril bundles. The outer layer of the macroscopic cellulosic fibers may be stripped away by a mechanical process or chemical process.

In a preferred embodiment, the outer layer of the macroscopic cellulosic fibers are stripped away by a mechanical process that comprises mechanical shearing to expose the fibril bundles. The macroscopic cellulosic fibers may be mechanically sheared until both the outer layer of the macroscopic cellulosic fibers are removed and the internal fibrils are released from each other to form the microfibrillated cellulosic fibers. The each of the fibrils that make up the microfibrillated cellulosic fibers have a relatively smaller diameter compared to the diameters of the macroscopic cellulosic fibers before processing.

The second fibrous component may be present in an amount ranging from about 0.25 wt. % to about 13.0 wt. % based on the total dry weight of the body 120—including all values and sub-ranges there-between. In some embodiments, the second fibrous component may be present in an amount ranging from about 0.5 wt. % to about 8.0 wt. % based on the total dry weight of the body 120—including all values and sub-ranges there-between. In a preferred embodiment, the second fibrous component may be present in an amount ranging from about 1.0 wt. % to about 3.0 wt. % based on the total dry weight of the body 120—including all values and sub-ranges there-between.

The fibers 130 of the present invention may comprise the first fibrous component and the second fibrous component in a weight ratio ranging from about 5:1 to about 20:1—including all ratios and sub-ranges there-between. In some embodiments, the fibers 130 of the present invention may comprise the first fibrous component and the second fibrous component in a weight ratio ranging from about 5:1 to about 15:1—including all ratios and sub-ranges there-between. In some embodiments, the first fibrous component and the second fibrous component may be present in a weight ratio ranging from about 5:1 to about 7.5:1—including all ratios and sub-ranges there-between. In some embodiments, the first fibrous component and the second fibrous component may be present in a weight ratio ranging from about 10:1 to about 13.5:1—including all ratios and sub-ranges there-between.

The fibers 130 of the present invention may comprise the inorganic fiber of the first fibrous component and the microfibrillated cellulosic fiber of the second fibrous component in a weight ratio ranging from about 15:1 to about 40:1—including all ratios and sub-ranges there-between. In some embodiments, the inorganic fiber of the first fibrous component and the macroscopic cellulosic fiber of the first fibrous component may be present in a weight ratio ranging from about 40:1 to about 80:1—including all ratios and sub-ranges there-between.

The body 120 may further comprise a binder. Non-limiting examples of binder may include a starch-based polymer, polyvinyl alcohol (PVOH), a latex, polysaccharide polymers, cellulosic polymers, protein solution polymers, an acrylic polymer, polymaleic anhydride, epoxy resins, or a combination of two or more thereof.

The binder may be present in an amount ranging from about 1 wt. % to about 20 wt. % based on the total dry weight of the body 120—including all values and sub-ranges there-between. In a preferred embodiment, the binder may be present in an amount ranging from about 5 wt. % to about 15 wt. % based on the total dry weight of the body 120—including all values and sub-ranges there-between. In a non-limiting example, the binder may comprise a starch-based polymer, which is present in an amount ranging from about 6 wt. % to about 12 wt. %—including all weight percentages and sub-range there-between—based on the total weight of the body 120.

The body 120 may further comprise a filler. Non-limiting examples of filler may include powders of calcium carbonate, limestone, titanium dioxide, sand, barium sulfate, clay, mica, dolomite, silica, talc, perlite, polymers, gypsum, wollastonite, expanded-perlite, calcite, aluminum trihydrate, pigments, zinc oxide, or zinc sulfate.

The filler may be present in an amount ranging from about 1.0 wt. % to about 30.0 wt. % based on the total dry weight of the body 120—including all values and sub-ranges there-between. In some embodiments, the filler may be present in an amount ranging from about 1.0 wt. % to about 20.0 wt. % based on the total dry weight of the body 120—including all values and sub-ranges there-between. In some embodiments, the filler may be present in an amount ranging from about 5.0 wt. % to about 18.0 wt. % based on the total dry weight of the body 120—including all values and sub-ranges there-between.

In a preferred embodiment, the filler may be perlite, which is present in an amount ranging from about 5 wt. % to about 17 wt. %—based on the total weight of the body 120—including all amounts and sub-ranges there-between.

In some embodiments, the body 120 may further comprise filler that includes calcium carbonate. The calcium carbonate may be present in the body 120 in an amount ranging from about 0.25 wt. % to 13 wt. %—based on the total weight of the body 120—including all amounts and sub-ranges there-between. In some embodiments, the calcium carbonate may be present in an amount ranging from about 0.5 wt. % to about 8 wt. % based on the total dry weight of the body 120—including all values and sub-ranges there-between. In some embodiments, the calcium carbonate may be present in an amount ranging from about 1.0 wt. % to about 3.0 wt. % based on the total dry weight of the body 120—including all values and sub-ranges there-between.

Non-limiting examples of additive include defoamers, wetting agents, biocides, dispersing agents, flame retardants, and the like. The additive may be present in an amount ranging from about 0.01 wt. % to about 30 wt. % based on the total dry weight of the body 120—including all values and sub-ranges there-between.

The body 120 may further comprise a flocculant. Non-limiting examples of flocculants include ionic flocculants, such as cationic polyacrylamide. The flocculant may be present in an amount ranging from about 0.01 wt. % to about 1.0 wt. % based on the total dry weight of the body 120—including all values and sub-ranges there-between.

The body 120 may be porous, thereby allowing airflow through the body 120 between the upper surface 122 and the lower surface 121—as discussed further herein. The porosity of the body 120 may allow for airflow through the body 120 under atmospheric conditions such that the building panel 100 may function as an acoustic ceiling panel, which requires properties related to noise reduction and sound attenuation properties—as discussed further herein.

Specifically, the body 120 of the present invention may have a porosity ranging from about 60% to about 98%—including all values and sub-ranges there between. In a preferred embodiment, the body 120 has a porosity ranging from about 75% to 95%—including all values and sub-ranges there between. According to the present invention, porosity refers to the following:

$$\%\ \text{Porosity}=[V_{Total}-(V_{Binder}+V_F+V_{Filler})]/V_{Total}$$

Where $V_{Total}$ refers to the total volume of the body 120 defined by the upper surface 122, the lower surface 121, and the body side surfaces 123. $V_{Binder}$ refers to the total volume occupied by the binder in the body 120. $V_F$ refers to the total volume occupied by the fibers 130 in the body 120. $V_{Filler}$ refers to the total volume occupied by the filler in the body 120. $V_{HC}$ refers to the total volume occupied by the hydrophobic component in the body 120. Thus, the % porosity represents the amount of free volume within the body 120.

The building panel 100 of the present invention comprising the porous body 120 may exhibit sufficient airflow for the building panel 100 to have the ability to reduce the amount of reflected sound in a room. The reduction in amount of reflected sound in a room is expressed by a Noise Reduction Coefficient (NRC) rating as described in American Society for Testing and Materials (ASTM) test method C423. This rating is the average of sound absorption coefficients at four ⅓ octave bands (250, 500, 1000, and 2000 Hz), where, for example, a system having an NRC of 0.90 has about 90% of the absorbing ability of an ideal absorber. A higher NRC value indicates that the material provides better sound absorption and reduced sound reflection.

The building panel 100 of the present invention exhibits an NRC of at least about 0.5. In a preferred embodiment, the building panel 100 of the present invention may have an NRC ranging from about 0.60 to about 0.99—including all value and sub-ranges there-between.

The body 100 may also exhibit an airflow resistance as measured between the upper surface 122 and the lower surface 121 that ranges from about 25 cgs rayls/cm to about 200 cgs rayls/cm—including all airflow resistances and sub-ranges there-between. In some embodiments, the body 100 may also exhibit an airflow resistance as measured between the upper surface 122 and the lower surface 121 that ranges from about 115 cgs rayls/cm to about 165 cgs rayls/cm—including all airflow resistances and sub-ranges there-between.

The body 120 may have an airflow resistance that is measured at one or more faces of the body 120. Airflow resistance is a measured by the following formula:

$$R=(P_A-P_{ATM})/\dot{V}$$

Where R is air flow resistance (measured in ohms); $P_A$ is the applied air pressure; $P_{ATM}$ is atmospheric air pressure; and $\dot{V}$ is volumetric airflow. The airflow resistance of the body 120 at the lower face 121 may range from about 0.5 ohm to about 10 ohms—including all resistances and sub-ranges there-between. The airflow resistance of the body 120 at the upper face 122 may range from about 0.5 ohm to about 10 ohms—including all resistances and sub-ranges there-between.

The body 120 in the dry-state may have a bulk density ranging from about 96 kg/m$^3$ to about 480 kg/m$^3$—including all integers and sub-ranges there between. In a preferred embodiment, the body may have a bulk density ranging from about 96 kg/m$^3$ to about 192 kg/m$^3$—including all values and sub-ranges there-between.

The term "bulk density" refers to the density as measured relative to the total volume $V_{Total}$ of the body 120. Therefore, bulk density is a density measurement of that includes the total volume $V_{Total}$, which includes both the volume occupied by the components that make up the skeleton of the body 120 (i.e., ($V_{Binder}+V_F+V_{HC}+V_{Filler}$) as well as the voids within the body 120 due to the porous nature of the body 120.

The body 120 in the dry-state may have a skeletal density ranging from about 1,500 kg/m$^3$ to about 2,400 kg/m$^3$—including all integers and sub-ranges there between. In a preferred embodiment, the body may have a skeletal density ranging from about 2,000 kg/m$^3$ to about 2,400 kg/m$^3$—including all values and sub-ranges there-between.

The term "skeletal density" refers to the density as measured relative to only the volume occupied by the components that make up the skeleton of the body 120 (i.e., ($V_{Binder}+V_F+V_{HC}+V_{Filler}$) without accounting for the volume occupied by the voids within the body 120 due to the porous nature of the body 120.

According to the present invention, it has been surprisingly discovered that the addition of the second fibrous component results in a marked improvement in strength to the resulting body 120 without a decrease in porosity that would result in a detrimental change to the airflow characteristics needed for the resulting building panel 100 to function as an acoustic building panel 100.

Specifically, it has been discovered that the addition of the second fibrous component may result in a body 120 having a strength that is at least 125% the strength of a body without the second fibrous component—as measured by the modulus of the body 120—preferably at least 150% the strength of a body without the second fibrous component.

Additionally, the presence of the second fibrous component may cause less than a 3% change in porosity to the body 120 compared to a body without the second fibrous component—preferably less than 2% change in porosity, preferably less than 1% change in porosity. Moreover, the body 120 of the present invention may exhibit the same or slightly greater densities (i.e., about 100% to about 110%) compared to a body formed without the second fibrous component.

The combination of increased strength at substantially the same density results in a building panel 100 that has superior sag-resistance, as the strength of the body 120 per unit of density has increased, as well as such building panels 100 may still operate in acoustic applications as the airflow resistance of such bodies 120 also remain substantially the same.

Although not pictured, the building panel 100 of the present invention may further comprise a scrim attached to at least one of the lower surface 121 or the upper surface 122 of the body 120. The scrim may be a non-woven scrim formed of glass fibers. In such embodiments, the first major surface 111 of the building panel 100 may comprise the scrim.

According to the present invention, the body 120 may be formed according to a standard wet-laid process that uses an aqueous medium (e.g., liquid water) to transport and form the body components into the desired structure. The basic process involves first blending the various body ingredients (e.g., fibers, binder, filler, etc.) into an aqueous slurry—(i.e., the wet-state), transporting the slurry to a forming station, and distributing the slurry over a moving, porous wire web into a uniform mat having the desired size and thickness. Water is removed, and the mat is then dried (i.e., the dry-state). The dried mat may be finished into the body by slitting, punching, coating and/or laminating a surface finish to the tile. The body 120 in the wet-state may be heated at an elevated temperature ranging from about 60° C. to about 300° C.—including all values and sub-ranges there-between—to dry the body 120 from the wet-state to the dry-state.

The following examples are prepared in accordance with the present invention. The present invention is not limited to the examples described herein.

EXAMPLES

Experiment 1

A first experiment was performed to test the impact on strength and porosity of the panels according to the present invention. Each of the panels comprised a body formed of a formulation set forth below in Table 1.

TABLE 1

| | Comp. Ex. 1 | Comp. Ex. 2 | Ex. 1 | Ex. 2 |
|---|---|---|---|---|
| Mineral Wool | 80.0 | 77.5 | 77.6 | 77.6 |
| MFC Fiber | — | — | 0.95 | 1.9 |
| Newspaper | 2.0 | 2.0 | 1.0 | — |
| $CaCO_3$ | — | 5.0 | 0.95 | 1.9 |
| Starch | 8.0 | 8.0 | 12.0 | 11.1 |
| Perlite | 10.0 | 7.5 | 7.5 | 7.5 |
| Total | 100.0 | 100.0 | 100.0 | 100.0 |

Each panel was then tested for bulk density, skeletal density, porosity, and strength (modulus). The results are set forth below in Table 2.

TABLE 2

| | Comp. Ex. 1 | Comp. Ex. 2 | Ex. 1 | Ex. 2 |
|---|---|---|---|---|
| Bulk Density (kg/m$^3$) | 129 | 137 | 143 | 145 |
| Skeletal Density (kg/m$^3$) | 1733 | 1821 | 1847 | 1801 |
| Porosity (%) | 92.6 | 92.4 | 92.3 | 91.9 |
| Modulus of Rupture (psi) | 62 | 78 | 111 | 116 |

As demonstrated by Table 2, the addition of MFC fiber resulted in a body exhibiting an marked improvement in strength, evidenced by the increase in modulus. Surprisingly, there was no material change in bulk density, skeletal density, or porosity of the body. Therefore, the body of the present invention provides a vast improvement in panel strength without any degradation in airflow characteristics, thereby allowing the board to maintain its acoustical properties. Without a change in density, the increase in strength results in an acoustical panel translates to superior sag resistance.

Experiment 2

A second experiment was performed to further test the strength, porosity, and airflow resistance of the panels according to the present invention. The panels of Comp. Ex. 3 and Ex. 3 were formed using water that was recycled from previous board manufacturing. The panels of Ex. 4 was formed using standard water supplied by the local municipality. The panels of this experiment each comprised a body formed of a formulation set forth below in Table 3.

TABLE 3

| | Comp. Ex. 3 | Ex. 3 | Ex. 4 |
|---|---|---|---|
| Mineral Wool | 70.5 | 70.5 | 70.5 |
| MFC Fiber | — | 2.2 | 2.2 |
| Newspaper | 6.4 | 2.0 | 2.0 |
| $CaCO_3$ | — | 2.2 | 2.2 |
| Binder | 8.0 | 8.0 | 8.0 |
| Perlite | 15.1 | 15.1 | 15.1 |
| Total | 100.0 | 100.0 | 100 |

Each panel was then tested for bulk density, skeletal density, porosity, and strength (modulus) and airflow resistance. The results are set forth below in Table 4.

TABLE 4

| | Comp. Ex. 3 | Ex. 3 | Ex. 4 |
|---|---|---|---|
| Bulk Density (kg/m$^3$) | 186 | 204 | 202 |
| Skeletal Density (kg/m$^3$) | 1577 | 1572 | 1632 |
| Porosity (%) | 88.2 | 87.0 | 87.5 |
| Modulus of Rupture (psi) | 116 | 178 | 155 |
| Face Ohms | 3.5 | 3.6 | 3.8 |
| Back Ohms | 3.7 | 4.2 | 4.1 |
| Flow Resistivity (cgs rayls/cm) | 119 | 158 | 132 |

As demonstrated by Table 4, the addition of MFC fiber resulted in a body exhibiting an marked improvement in strength, evidenced by the increase in modulus. Accounting for the different in porosity for each example, it was determined that the body of Ex. 3 exhibits close to a 30% increase in modulus when adjusting for differences in porosity. Stated differently, when adjusting the porosity of the body of Ex. 3 to be equal to the porosity of the body of Comp. Ex. 3, the resulting modulus of rupture of the body of Ex. 3 would be about 30% greater than the body of Comp. Ex. 3—thereby confirming the relative increase in strength. Even more surprising is that such improved strength in the body is found when the body is formed from a recycled water source—thereby providing a method of forming the building panel according to the present invention that saves cost and is better for the environment.

The same adjustment was calculated for face and back ohms of the boards. The resulting calculation determined that body of Ex. 3 would exhibit an airflow resistance of approximately 2.6 ohms at the same porosity of Comp. Ex. 3—thereby confirming the surprising result that the addition of the second fibrous component does not increase airflow resistance through the body of the present invention.

Experiment 3

A third experiment was performed to further test the high-humidity sag-resistance of panels of the present invention. According to this experiment, the 3"×24" strips of each body of Examples 3 and 4, as well as Comparative Example 3, were subject to a 90% humidity cycle. An edge portion of each board was supported on a surface, with the remaining portion of each body extending off the surface. The total amount of sag for each body was then measured after the completion of the 90% humidity cycle. The results are set forth below in Table 5.

TABLE 5

| | Comp. Ex. 3 | Ex. 3 | Ex. 4 |
|---|---|---|---|
| Total Sag (mm) | 7.5 | 3.9 | 3.7 |

As demonstrated by Table 5, the addition of the second fibrous component resulted in a large improvement in sag-resistance in high-humidity environments compared to bodies formed without the second fibrous component.

What is claimed is:

1. An acoustic building panel comprising:

a body comprising:

starch in an amount ranging from about 8.0 wt. % to about 15.0 wt. % based on the total weight of the body;

inorganic fiber in an amount ranging from about 60.0 wt. % to about 90.0 wt. % based on the total weight of the body; and microfibrillated fiber in an amount ranging from about 0.25 wt. % to about 12.5 wt. % based on the total weight of the body.

2. The acoustic building panel according to claim 1, wherein the body further comprises a filler selected from the group consisting of perlite, calcium carbonate, limestone, titanium dioxide, sand, barium sulfate, clay, mica, dolomite, silica, talc, wollastonite, calcite, aluminum trihydrate, pigments, zinc oxide, zinc sulfate, and combinations thereof, wherein the filler is present in an amount ranging from about 1.0 wt. % to about 30.0 wt. % based on the total weight of the body.

3. The acoustic building panel according to claim 1, wherein the body has a bulk density ranging from about 96 kg/m$^3$ to about/ft$^3$ 480 kg/m$^3$.

4. The acoustic building panel according to claim 1, wherein the body has a first major surface opposite a second major surface and a side surface extending therebetween, the body exhibit an airflow resistance ranging from about 120 cgs rayls/cm to about 170 cgs rayls/cm.

5. An acoustic building panel comprising:

a body comprising:

starch;

inorganic fiber; and microfibrillated fiber;

wherein the body has a bulk density ranging from 96 kg/m$^3$ to about 480 kg/m$^3$.

6. The acoustic building panel according to claim 5, wherein the inorganic fiber and the microfibrillated fiber are present in a weight ratio ranging from about 5:1 to about 20:1.

7. The acoustic building panel according to claim 5, wherein the skeletal density of the body ranges from about 1,500 kg/m$^3$ to about 2,400 kg/m$^3$.

8. The acoustic building panel according to claim 5, wherein the inorganic fiber is present in an amount ranging from about 60.0 wt. % to about 90.0 wt. % based on the total weight of the body.

9. The acoustic building panel according to claim 5, wherein the microfibrillated fiber is present in an amount ranging from about 0.25 wt. % to about 12.5 wt. % based on the total weight of the body.

10. The acoustic building panel according to claim 5, wherein the body further comprises a filler that includes wherein the perlite is present in an amount ranging from about 1.0 wt. % to about 30.0 wt. % based on the total weight of the body.

11. The acoustic building panel according to claim 5, wherein the starch is present in an amount ranging from about 8.0 wt. % to about 15.0 wt. % based on the total weight of the body.

12. The acoustic building panel according to claim 5, wherein the body has a first major surface opposite a second major surface and a side surface extending therebetween, the body exhibit an airflow resistance ranging from about 120 cgs rayls/cm to about 170 cgs rayls/cm.

13. An acoustic building panel comprising:

a body comprising:

inorganic fiber;

microfibrillated fiber; and calcium carbonate, wherein the body has a porosity ranging from about 80.0% to about 95.0%; and wherein the microfibrillated fiber and calcium carbonate are present at a ratio of about 1:1.

14. The acoustic building panel according to claim 13, wherein the inorganic fiber and the microfibrillated fiber are present in a weight ratio ranging from about 5:1 to about 20:1.

15. The acoustic building panel according to claim 13, wherein the inorganic fiber is present in an amount ranging from about 60.0 wt. % to about 90.0 wt. % based on the total weight of the body.

16. The acoustic building panel according to claim 13, wherein the microfibrillated fiber is present in an amount ranging from about 0.25 wt. % to about 12.5 wt. % based on the total weight of the body.

17. The acoustic building panel according to claim 13, wherein the body further comprises a filler that includes wherein the perlite is present in an amount ranging from about 1.0 wt. % to about 30.0 wt. % based on the total weight of the body.

18. The acoustic building panel according to claim 13, wherein the body further comprises starch, wherein the starch is present in an amount ranging from about 8.0 wt. % to about 15.0 wt. % based on the total weight of the body.

19. The acoustic building panel according to claim 13, wherein the body has a first major surface opposite a second major surface and a side surface extending therebetween, the body exhibit an airflow resistance ranging from about 120 cgs rayls/cm to about 170 cgs rayls/cm.

* * * * *